US007013582B2

(12) United States Patent
Lucas et al.

(10) Patent No.: US 7,013,582 B2
(45) Date of Patent: Mar. 21, 2006

(54) FULL LENGTH CARTRIDGE CUSHIONING SYSTEM

(75) Inventors: Robert J. Lucas, Erlangen (DE); Vincent Philippe Rouiller, Herzogenaurach (DE); Allen W. Van Noy, Weisendorf (DE); Stephen Michael Vincent, Herzogenaurach (DE)

(73) Assignee: adidas International Marketing B.V., Amsterdam (NL)

( * ) Notice: Subject to any disclaimer, the term of this patent is extended or adjusted under 35 U.S.C. 154(b) by 139 days.

(21) Appl. No.: 10/619,652

(22) Filed: Jul. 15, 2003

(65) Prior Publication Data

US 2004/0049946 A1 Mar. 18, 2004

(30) Foreign Application Priority Data

Jul. 31, 2002 (DE) ..... 102 34 913

(51) Int. Cl.
*A43B 13/18* (2006.01)

(52) U.S. Cl. ..... 36/28; 36/29; 36/30 R

(58) Field of Classification Search ..... 36/25 R, 36/29, 30 R, 31

See application file for complete search history.

(56) References Cited

U.S. PATENT DOCUMENTS

| | | | | |
|---|---|---|---|---|
| 1,841,942 | A | | 1/1932 | Fenton |
| 2,224,590 | A | | 12/1940 | Boivin |
| 2,547,480 | A | | 4/1951 | McDaniel |
| 2,863,231 | A | | 12/1958 | Jones |
| 3,834,046 | A | | 9/1974 | Fowler |
| 4,000,566 | A | | 1/1977 | Famolare, Jr. |
| D247,267 | S | | 2/1978 | Dolinsky |
| 4,083,125 | A | | 4/1978 | Benseler et al. |
| 4,130,947 | A | | 12/1978 | Denu |
| 4,139,187 | A | | 2/1979 | Hanusa |
| 4,224,774 | A | | 9/1980 | Petersen |
| 4,236,326 | A | | 12/1980 | Inohara |
| 4,296,557 | A | | 10/1981 | Pajevic |
| 4,314,413 | A | | 2/1982 | Dassler |
| 4,354,318 | A | | 10/1982 | Frederick et al. |
| 4,364,189 | A | | 12/1982 | Bates |
| 4,391,048 | A | | 7/1983 | Lutz |
| 4,438,573 | A | | 3/1984 | McBarron |
| 4,451,994 | A | | 6/1984 | Fowler |
| 4,492,046 | A | | 1/1985 | Kosova |
| 4,498,251 | A | * | 2/1985 | Shin ..... 36/30 R |
| 4,506,461 | A | | 3/1985 | Inohara |
| 4,507,879 | A | | 4/1985 | Dassler |
| 4,523,393 | A | | 6/1985 | Inohara |
| 4,524,529 | A | | 6/1985 | Schaefer |
| 4,535,553 | A | * | 8/1985 | Derderian et al. ..... 36/28 |
| 4,536,974 | A | | 8/1985 | Cohen |
| 4,551,930 | A | | 11/1985 | Graham et al. |
| 4,566,206 | A | | 1/1986 | Weber |
| 4,592,153 | A | | 6/1986 | Jacinto |
| 4,610,099 | A | | 9/1986 | Signori |
| 4,611,412 | A | | 9/1986 | Cohen |

(Continued)

FOREIGN PATENT DOCUMENTS

| | | |
|---|---|---|
| DE | 41 14 551 | 5/1992 |

(Continued)

*Primary Examiner*—Ted Kavanaugh
(74) *Attorney, Agent, or Firm*—Goodwin Procter LLP

(57) ABSTRACT

The invention relates to a shoe sole for an article of footwear, in particular a sports shoe. The sole includes a first area having a first deformation element and a second area having a second deformation element. The first deformation element includes a foamed material and the second deformation element includes an open-walled or honeycomb-like structure that is free from foamed materials.

32 Claims, 11 Drawing Sheets

U.S. PATENT DOCUMENTS 4,616,431 A 10/1986 Dassler
4,617,745 A 10/1986 Batra
4,624,061 A * 11/1986 Wezel et al. ..... 36/30 A
4,654,983 A 4/1987 Graham et al.
4,676,010 A 6/1987 Cheskin
4,676,011 A 6/1987 O'Rourke et al.
4,753,021 A 6/1988 Cohen
4,754,559 A * 7/1988 Cohen ..... 36/3 B
4,759,136 A 7/1988 Stewart et al.
4,771,554 A 9/1988 Hannemann
4,774,774 A 10/1988 Allen, Jr.
4,798,009 A 1/1989 Colonel et al.
4,843,741 A 7/1989 Yung-Mao
4,864,738 A 9/1989 Horovitz
4,874,640 A 10/1989 Donzis
4,876,053 A 10/1989 Norton et al.
4,881,329 A 11/1989 Crowley
4,905,383 A 3/1990 Beckett et al.
4,910,884 A 3/1990 Lindh et al.
4,918,841 A 4/1990 Turner et al.
4,934,070 A 6/1990 Mauger
4,947,560 A 8/1990 Fuerst et al.
4,972,611 A 11/1990 Swartz et al.
4,999,931 A 3/1991 Vermeulen
5,014,706 A 5/1991 Philipp
5,048,203 A 9/1991 Kling
5,052,130 A 10/1991 Barry et al.
5,060,401 A 10/1991 Whatley
5,070,629 A 12/1991 Graham et al.
D324,940 S 3/1992 Claveria
D326,956 S 6/1992 Damianoe et al.
5,131,173 A 7/1992 Anderie
D330,797 S 11/1992 Lucas
5,189,816 A 3/1993 Shibata
5,191,727 A 3/1993 Barry et al.
5,195,254 A 3/1993 Tyng
5,195,256 A * 3/1993 Kim ..... 36/27
D336,561 S 6/1993 Hatfield
D343,272 S 1/1994 James
5,279,051 A 1/1994 Whatley
D344,174 S 2/1994 Kilgore
D347,105 S 5/1994 Johnson
5,337,492 A 8/1994 Anderie et al.
D350,227 S 9/1994 Kilgore
D350,433 S 9/1994 Kilgore
5,343,639 A 9/1994 Kilgore et al.
D351,057 S 10/1994 Kilgore
5,353,523 A 10/1994 Kilgore et al.
5,353,526 A 10/1994 Foley et al.
5,353,528 A 10/1994 Demardhi
D352,160 S 11/1994 Kilgore
5,367,792 A * 11/1994 Richard et al. ..... 36/114
D354,617 S 1/1995 Kilgore
5,381,608 A 1/1995 Claveria
D355,755 S 2/1995 Kilgore
5,461,800 A 10/1995 Luthi et al.
5,469,638 A 11/1995 Crawford, III
5,469,639 A 11/1995 Sessa
5,488,786 A 2/1996 Ratay
5,493,792 A 2/1996 Bates et al.
5,502,901 A 4/1996 Brown
5,511,324 A 4/1996 Smith
5,513,448 A 5/1996 Lyons
5,544,431 A 8/1996 Dixon
5,560,126 A 10/1996 Meschan et al.
5,577,334 A 11/1996 Park
D376,471 S 12/1996 Kaline et al.
5,615,497 A 4/1997 Meschan
5,625,964 A 5/1997 Lyden et al.
5,644,857 A 7/1997 Ouellette et al.
5,671,552 A 9/1997 Pettibone et al.
5,678,327 A 10/1997 Halberstadt
5,701,686 A 12/1997 Herr et al.
5,718,063 A 2/1998 Yamashita et al.
5,743,028 A 4/1998 Lombardino
5,752,329 A 5/1998 Horibata
5,761,831 A 6/1998 Cho
5,782,014 A 7/1998 Peterson
5,806,208 A 9/1998 French
5,806,209 A 9/1998 Crowley et al.
5,806,210 A 9/1998 Meschan
5,822,886 A 10/1998 Luthi et al.
5,826,352 A 10/1998 Meschan et al.
5,852,886 A 12/1998 Slepian et al.
5,875,567 A 3/1999 Bayley
5,875,568 A 3/1999 Lennihan, Jr.
5,893,219 A 4/1999 Smith et al.
5,918,384 A 7/1999 Meschan
5,937,544 A 8/1999 Russell
5,937,545 A 8/1999 Dyer et al.
5,970,628 A 10/1999 Meschan
5,983,529 A 11/1999 Serna
5,987,781 A 11/1999 Pavesi et al.
5,996,253 A 12/1999 Spector
5,996,260 A 12/1999 MacNeill
6,006,449 A 12/1999 Orlowski et al.
6,023,859 A 2/2000 Burke et al.
6,029,374 A 2/2000 Herr et al.
6,050,002 A 4/2000 Meschan
6,055,746 A 5/2000 Lyden et al.
6,115,944 A 9/2000 Lain
6,127,010 A 10/2000 Rudy
D434,549 S 12/2000 Solaroli
6,195,916 B1 3/2001 Meschan
6,199,302 B1 3/2001 Kayano
6,237,251 B1 5/2001 Litchfield et al.
6,253,466 B1 7/2001 Harmon-Weiss et al.
6,282,814 B1 9/2001 Krafsur et al.
6,324,772 B1 12/2001 Meschan
D453,989 S 3/2002 Cagner
6,354,020 B1 3/2002 Kimball et al.
6,487,796 B1 12/2002 Avar et al.
6,568,102 B1 5/2003 Healy et al.
6,604,300 B1 8/2003 Meschan
6,662,471 B1 12/2003 Meschan
2002/0078601 A1 6/2002 Alfond et al.
2002/0129516 A1 9/2002 Lucas et al.
2002/0189132 A1 12/2002 Yamamoto
2003/0000109 A1 * 1/2003 Kita ..... 36/30 R

FOREIGN PATENT DOCUMENTS

DE G 92 10 113.5 11/1992
EP 0 299 669 1/1989
EP 0 192 820 12/1990
EP 0 359 421 B1 8/1994
EP 0 558 541 B1 12/1994
EP 0 694 264 A2 1/1996
EP 0 714 246 6/1996
EP 0 752 216 A2 1/1997
EP 0 815 757 A2 1/1998
EP 0 877 177 A2 11/1998
EP 0 714 611 12/1998
EP 0 916 277 A1 5/1999
EP 1 118 280 7/2001
EP 0 741 529 B1 10/2001
JP S63-2475 5/1993
WO WO 95/20333 8/1995
WO WO 97/13422 4/1997
WO 99/04662 2/1999
WO 99/29203 6/1999
WO 01/17384 3/2001

* cited by examiner

FULL LENGTH CARTRIDGE CUSHIONING SYSTEM

CROSS-REFERENCES TO RELATED APPLICATIONS

This application incorporates by reference, and claims priority to and the benefit of, German patent application serial number 10234913.4-26, filed on Jul. 31, 2002, and European patent application serial number 03006874.6, filed on Mar. 28, 2003.

TECHNICAL FIELD

The present invention generally relates to a shoe sole. In particular, the invention relates to a full length cartridge cushioning system for the sole of a sports shoe.

BACKGROUND

When shoes, in particular sports shoes, are manufactured, two objectives are to provide a good grip on the ground and to sufficiently cushion the ground reaction forces arising during the step cycle, in order to reduce strain on the muscles and the bones. In traditional shoe manufacturing, the first objective is addressed by the outsole; whereas, for cushioning, a midsole is typically arranged above the outsole. In shoes subjected to greater mechanical loads, the midsole is typically manufactured from continuously foamed ethylene vinyl acetate (EVA).

Detailed research of the biomechanics of a foot during running has shown, however, that a homogeneously shaped midsole is not well suited for the complex processes occurring during the step cycle. The course of motion from ground contact with the heel until push-off with the toe part is a three-dimensional process including a multitude of complex rotating movements of the foot from the lateral side to the medial side and back.

To better control this course of motion, separate cushioning elements have, in the past, been arranged in certain parts of the midsole. The separate cushioning elements selectively influence the course of motion during the various phases of the step cycle. An example of such a sole construction is found in German Patent No. DE 101 12 821, the disclosure of which is hereby incorporated herein by reference in its entirety. The heel area of the shoe disclosed in that document includes several separate deformation elements having different degrees of hardness. During ground contact with the heel, the deformation elements bring the foot into a correct position for the subsequent rolling-off and pushing-off phases. Typically, the deformation elements are made from foamed materials such as EVA or polyurethane (PU).

Although foamed materials are generally well suited for use in midsoles, it has been found that they cause considerable problems in certain situations. For example, a general shortcoming, and a particular disadvantage for running shoes, is the comparatively high weight of the dense foams.

A further disadvantage is the low temperature properties of the foamed materials. One may run or jog during every season of the year. However, the elastic recovery of foamed materials decreases substantially at temperatures below freezing, as exemplified by the dashed line in the hysteresis graph of FIG. 6C, which depicts the compression behavior of a foamed deformation element at −25° C. As can be seen, the foamed deformation element loses to a great extent its elastic recovery and, as represented by the arrow 9 in FIG. 6C, partly remains in a compressed state even after the external force has been completely removed. Similar effects, as well as an accelerated wear of the foamed materials, are also observed at higher temperatures.

Additionally, where foamed materials are used, the ability to achieve certain deformation properties is very limited. The thickness of the foamed materials is, typically, determined by the dimensions of the shoe sole and is not, therefore, variable. As such, the type of foamed material used is the only parameter that may be varied to yield a softer or harder cushioning, as desired.

Accordingly, foamed materials in the midsole have, in some cases, been replaced by other elastically deformable structures. For example, U.S. Pat. Nos. 4,611,412 and 4,753,021, the disclosures of which are hereby incorporated herein by reference in their entirety, disclose ribs that run in parallel. The ribs are optionally interconnected by elastic bridging elements. The bridging elements are thinner than the ribs themselves so that they may be elastically stretched when the ribs are deflected. Further examples may be found in European Patents Nos. EP 0 558 541, EP 0 694 264, and EP 0 741 529, U.S. Pat. Nos. 5,461,800 and 5,822,886, and U.S. Des. Pat. No. 376,471, all the disclosures of which are also hereby incorporated herein by reference in their entirety.

These constructions for the replacement of the foamed materials are not, however, generally accepted. They do not, for instance, demonstrate the advantageous properties of foamed materials at normal temperatures, such as, for example, good cushioning, comfort for the wearer resulting therefrom, and durability.

It is, therefore, an object of the present invention to provide a shoe sole that overcomes both the disadvantages present in shoe soles having foamed materials and the disadvantages present in shoe soles having other elastically deformable structures.

SUMMARY OF THE INVENTION

The present invention relates to a shoe sole, in particular for a sports shoe, having a first area with a first deformation element and a second area with a second deformation element. The first deformation element includes a foamed material and the second deformation element has an open-walled or honeycomb-like structure that is free of foamed materials.

Combining first deformation elements having foamed materials in a first sole area with second deformation elements having open-walled or honeycomb-like structures that are free of foamed materials in a second sole area harnesses the advantages of the two aforementioned construction options for a shoe sole and eliminates their disadvantages. The foamed materials provide an optimally even deformation behavior when the ground is contacted with the shoe sole of the invention and the second deformation elements simultaneously ensure a minimum elasticity, even at extremely low temperatures.

In one aspect, the invention relates to a sole for an article of footwear. The sole includes a first area having a first deformation element that includes a foamed material and a second area having a second deformation element that includes an open-walled or honeycomb-like structure that is free from foamed materials.

In another aspect, the invention relates to an article of footwear that includes an upper and a sole. The sole includes a first area having a first deformation element that includes a foamed material and a second area having a second deformation element that includes an open-walled or honeycomb-like structure that is free from foamed materials.

In various embodiments of the foregoing aspects of the invention, the second deformation element further includes at least two side walls and at least one tension element interconnecting the side walls. The side walls and the tension element may form a single integral piece that may be made from a thermoplastic material, such as, for example, a thermoplastic polyurethane. In one embodiment, the thermoplastic material has a hardness between about 70 Shore A and about 85 Shore A. In one particular embodiment, the hardness of the thermoplastic material is between about 75 Shore A and about 80 Shore A.

In another embodiment, at least one of the tension element and the side walls has a thickness from about 1.5 mm to about 5 mm. Moreover, a thickness of at least one of the tension element and the side walls may increase along a length of the second deformation element. In yet another embodiment, the side walls are further interconnected by at least one of an upper side and a lower side.

In still other embodiments, the sole includes two second deformation elements arranged adjacent each other. At least one of an upper side and a lower side may interconnect adjacent side walls of the two second deformation elements. The two second deformation elements may be further interconnected by at least one of an upper connecting surface and a lower connecting surface. The connecting surface may include a three-dimensional shape for adaptation to additional sole components.

In further embodiments, the tension element interconnects center regions of the side walls. At least one of the side walls may also have a non-linear configuration. In additional embodiments, the first area is arranged in an aft portion of a heel region of the sole and the second area is arranged in a front portion of the heel region of the sole. In other embodiments, the first area is arranged to correspond generally to metatarsal heads of a wearer's foot and the second area is arranged fore of and/or aft of the metatarsal heads of the wearer's foot.

In still other embodiments, the first deformation element includes at least one horizontally extending indentation. Additionally, the first deformation element and the second deformation element may be arranged below at least a portion of at least one load distribution plate of the sole. The load distribution plate may at least partially three-dimensionally encompass at least one of the first deformation element and the second deformation element. Further, in one embodiment, the first deformation element includes a shell defining a cavity at least partially filled with the foamed material. The shell may include a thermoplastic material, such as, for example, a thermoplastic urethane, and the foamed material may include a polyurethane foam. Moreover, the shell may include a varying wall thickness.

In another embodiment, the first deformation element is arranged at least partially in a rearmost portion of the sole and the cavity includes a lateral chamber and a medial chamber. In one embodiment, the lateral chamber is larger than the medial chamber. A bridging passage, which, in one embodiment, is filled with the foamed material, may interconnect the lateral chamber and the medial chamber. In a further embodiment, the shell defines a recess open to an outside and the recess is arranged between the lateral chamber and the medial chamber.

These and other objects, along with the advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the present invention are described with reference to the following drawings, in which.

DETAILED DESCRIPTION OF THE INVENTION

Embodiments of the present invention are described below. It is, however, expressly noted that the present invention is not limited to these embodiments, but rather the intention is that modifications that are apparent to the person skilled in the art are also included. In particular, the present invention is not intended to be limited to soles for sports shoes, but rather it is to be understood that the present invention can also be used to produce soles or portions thereof for any article of footwear. Further, only a left or right sole and/or shoe is depicted in any given figure; however, it is to be understood that the left and right soles/shoes are typically mirror images of each other and the description applies to both left and right soles/shoes. In certain activities that require different left and right shoe configurations or performance characteristics, the shoes need not be mirror images of each other.

Figure 1:
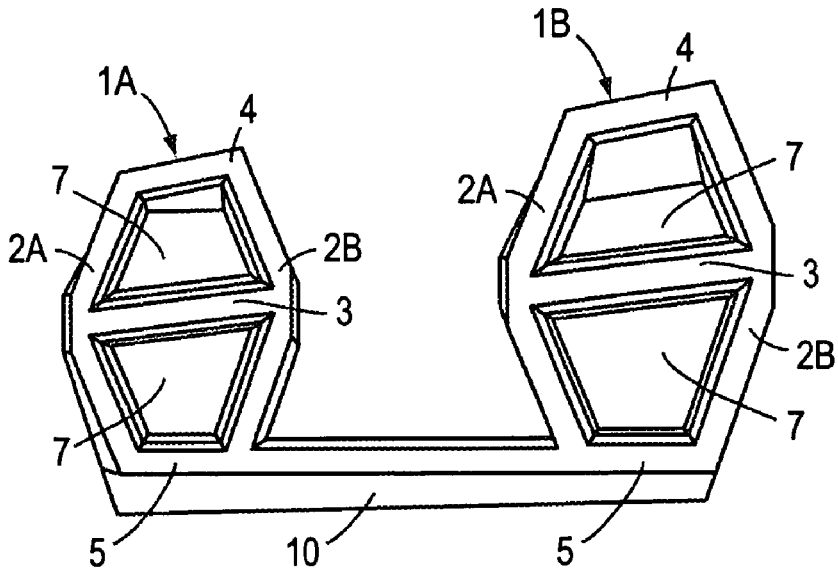
FIG. 1 is a schematic side view of two second deformation elements in accordance with one embodiment of the invention interconnected for use.

FIG. 1 depicts one embodiment of second deformation elements 1A, 1B for a shoe sole 50 (see FIG. 8) in accordance with the invention. As shown, the second deformation elements 1A, 1B are open-walled structures that define hollow volumes 7 within the shoe sole 50 and are free from any foamed material. In comparison to standard foamed materials of similar size, the second deformation elements 1A, 1B are reduced in weight by about 20% to about 30%. In one embodiment, each second deformation element 1A, 1B has a honeycomb-like shape that includes two facing and non-linear (e.g., slightly angled) side walls 2A, 2B. Alternatively, in other embodiments, the second deformation elements 1A, 1B assume a variety of other shapes.

The side walls 2A, 2B may be interconnected by a tension element 3. The structure provided by the side walls 2A, 2B and the interconnecting tension element 3 results in deformation properties for the shoe sole 50 of the invention that substantially correspond to the behavior of an ordinary midsole made exclusively of foamed materials. As explained below, when small forces are applied to the second deformation elements 1A, 1B, small deformations of the side walls 2A, 2B result. When larger forces are applied, the resulting tension force on the tension element 3 is large enough to extend the tension element 3 and thereby provide for a larger deformation. Over a wide range of loads, this structure results in deformation properties that correspond to the those of a standard foamed midsole.

Figure 3:
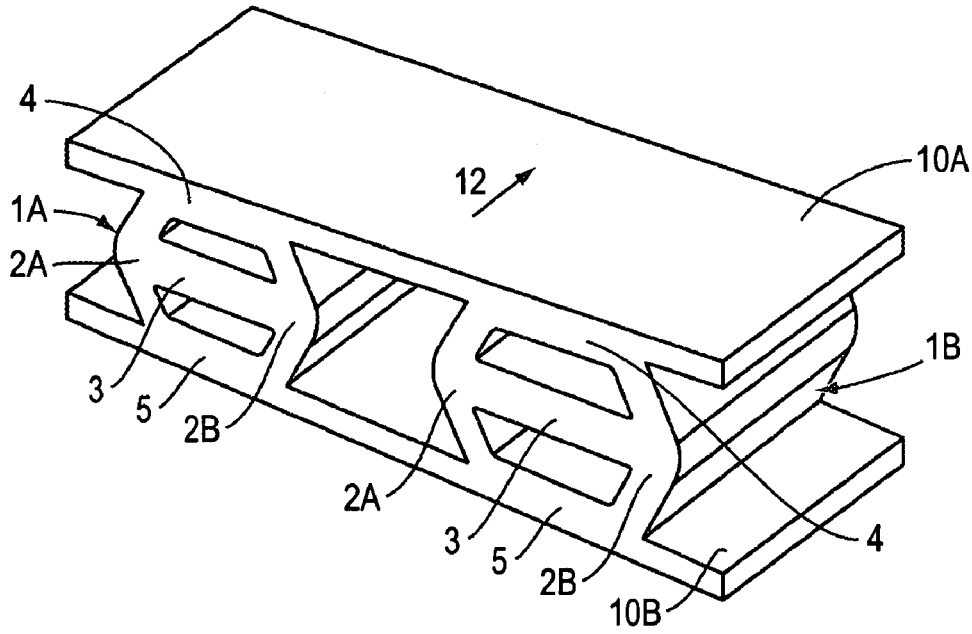
FIG. 3 is a schematic perspective view of an alternative embodiment of two second deformation elements in accordance with the invention interconnected in an unloaded state.

In one embodiment, the tension element 3 extends from approximately a center region of one side wall 2A to approximately a center region of the other side wall 2B. The thickness of the side walls 2A, 2B and of the tension element 3, and the location of the tension element 3, may be varied to suit a particular application. For example, the thickness of the side walls 2A, 2B and of the tension element 3 may be varied in order to design mechanical properties with local differences. In one embodiment, the thickness of the side walls 2A, 2B and/or of the tension element 3 increases along a length of each of the second deformation elements 1A, 1B, as illustrated in FIG. 3 by the arrow 12. In the case of injection-molding production, this draft facilitates removal of the second deformation element 1A, 1B from the mold. In one embodiment, the thickness of the side walls 2A, 2B and/or of the tension element 3 ranges from about 1.5 mm to about 5 mm.

Referring again to FIG. 1, in one embodiment, the side walls 2A, 2B of each second deformation element 1A, 1B are further interconnected by an upper side 4 and a lower side 5. The upper side 4 and the lower side 5 serve as supporting surfaces. Additionally, in another embodiment, two or more of the second deformation elements 1 are interconnected to each other at their lower side 5 by a connecting surface 10, as shown. Alternatively, the connecting surface 10 may interconnect two or more of the second deformation elements 1 at their upper side 4. The connecting surface 10 stabilizes the two or more second deformation elements 1A, 1B. Additionally, the connecting surface 10 provides a greater contact surface for attachment of the second deformation elements 1A, 1B to other sole elements and thereby facilitates the anchoring of the second deformation elements 1A, 1B to the shoe sole 50. The second deformation elements 1A, 1B may be attached to other sole elements by, for example, gluing, welding, or other suitable means.

In another embodiment, the connecting surface 10 is three-dimensionally shaped in order to allow a more stable attachment to other sole elements, such as, for example, a load distribution plate 52, which is described below with reference to FIGS. 7 and 8. The three dimensional shape of the connecting surface 10 also helps to increase the lifetime of the shoe sole 50. In one embodiment, referring now to FIG. 2, a recess 11 in the connecting surface 10 gives the connecting surface 10 its three dimensional shape.

Figure 2:
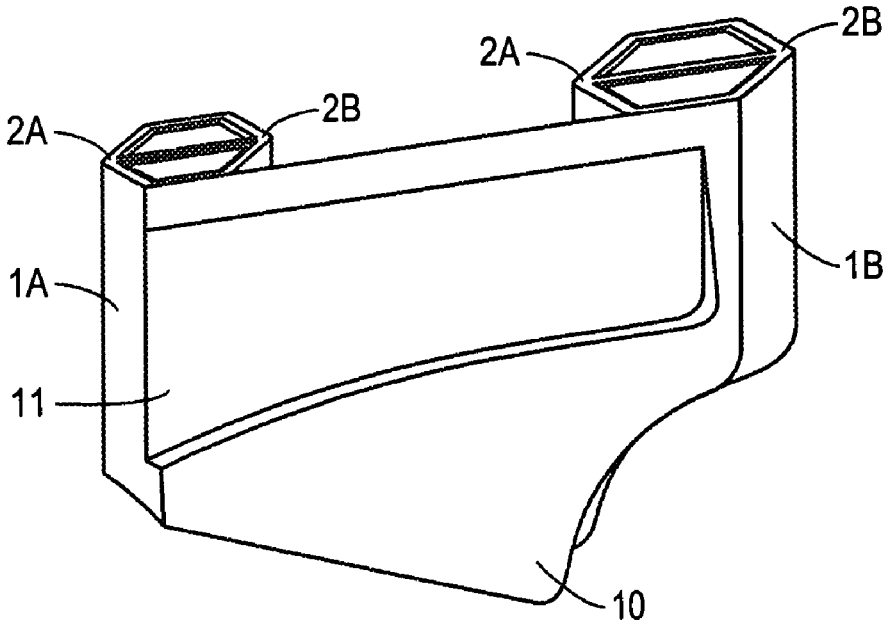
FIG. 2 is a schematic perspective bottom view of the two second deformation elements of FIG. 1.

In one embodiment, as shown in FIGS. 1 and 2, one second deformation element 1B is larger in size than the other second deformation element 1A. This reflects the fact that the second deformation elements 1A, 1B are, in one embodiment, arranged in regions of the shoe sole 50 having different thicknesses.

Figure 4:
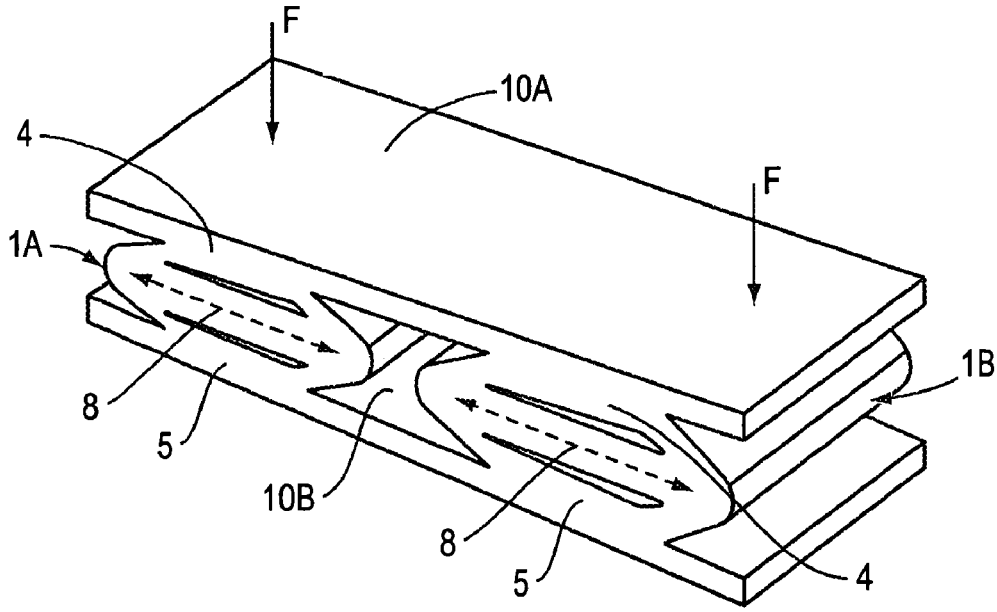
FIG. 4 is a schematic perspective view of the two second deformation elements of FIG. 3 in a compressed state.

FIGS. 3 and 4 depict an alternative embodiment of interconnected second deformation elements 1A, 1B. As shown, the second deformation elements 1A, 1B are interconnected at both their upper side 4 and their lower side 5 by connecting surfaces 10A, 10B, respectively. Whereas FIG. 3 depicts the unloaded state of the second deformation elements 1A, 1B, FIG. 4 schematically depicts the loaded state of the second deformation elements 1A, 1B. In the case of a small load, there is only a small deflection of the side walls 2A, 2B without a substantial change in shape of the tension element 3. Greater loads, however, results in an elongation of the tension element 3. Larger pressure forces F acting from above, and/or from below, are, therefore, transformed by the second deformation elements 1A, 1B into a tension inside the tension element 3, as indicated by dashed double headed arrows 8 in FIG. 4. Due to the tension element 3, the second deformation elements 1A, 1B, even in the case of a peak load, are not simply flattened, but, rather, elastically deformed. This approximates the results that would otherwise be achieved by using deformation elements made from foamed materials.

Figure 5:
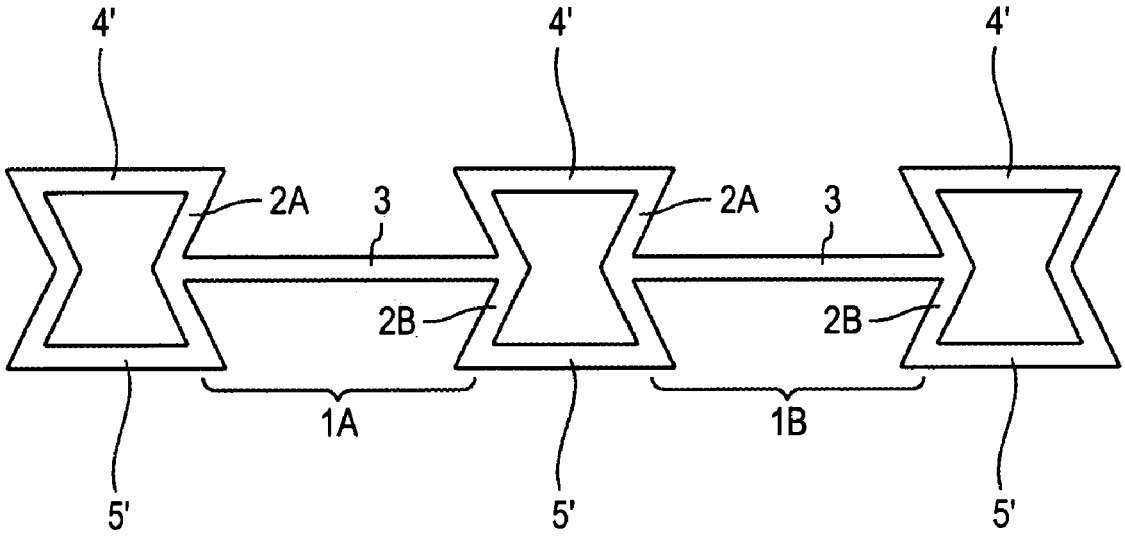
FIG. 5 is a schematic side view an alternative embodiment of a series of second deformation elements in accordance with the invention.

FIG. 5 depicts yet another embodiment of interconnected second deformation elements 1A, 1B for use in a shoe sole 50 in accordance with the invention. Unlike the illustrative embodiments of FIGS. 1–4, the side walls 2A, 2B of the same second deformation element 1A or 1B are not interconnected by an upper side 4 or a lower side 5. Rather, the structure has been modified such that an upper side 4' and a lower side 5' each interconnect side walls 2A, 2B of adjacent second deformation elements 1A, 1B. In this alternative embodiment, a connecting surface 10 may also be used to interconnect a number of the second deformation elements 1 on their upper side 4 and/or lower side 5. The illustrative embodiment of the second deformation elements 1A, 11B shown in FIG. 5 is particularly appropriate for use in sole areas having a low height, such as, for example, at the front end of shoe sole 50.

Figure 6A:
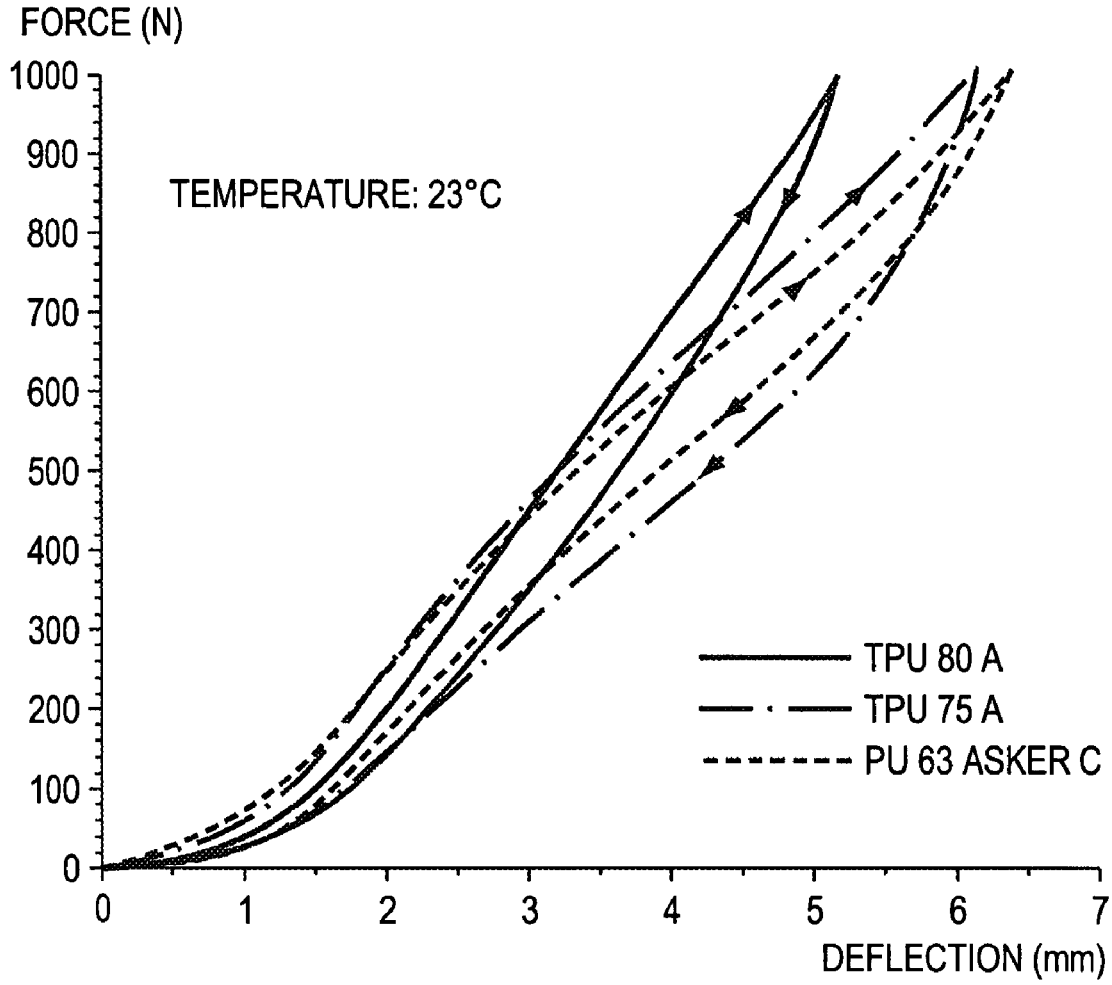
FIG. 6A is a graph depicting comparative measurements of the deformation properties at 23° C. of second deformation elements in accordance with the invention and of a prior art deformation element made out of a foamed material.
Figure 6B:
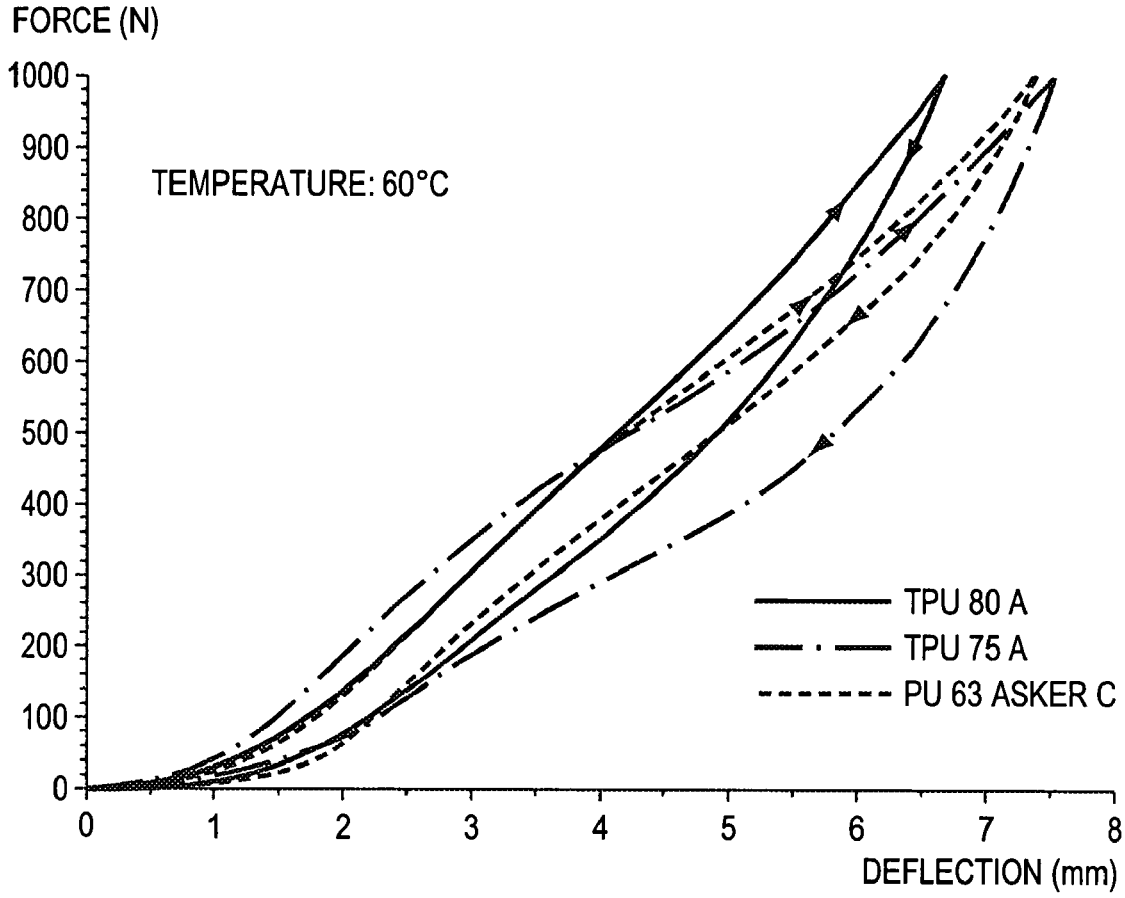
FIG. 6B is a graph depicting comparative measurements of the deformation properties at 60° C. of second deformation elements in accordance with the invention and of a prior art deformation element made out of a foamed material.

FIGS. 6A and 6B depict the strong similarity in deformation characteristics, at a surrounding temperature of 23° C. and 60° C., respectively, between the second deformation elements 1 of the present invention and a prior art deformation element made from foamed materials. Referring to FIGS. 6A and 6B, hysteresis curves for the deflection of two different second deformation elements 1 according to the invention are shown. In a first case, the second deformation elements 1 are made from thermoplastic polyurethane (TPU) with a Shore A hardness of 80. In a second case, the second deformation elements 1 are made from TPU with a Shore A hardness of 75. For comparison purposes, a hysteresis curve for a prior art foamed deformation element made from polyurethane with an Asker C hardness of 63 is also depicted. These are typical values for deformation elements used in the midsoles of sports shoes.

In the graphs of FIGS. 6A and 6B, the force applied to the deformation elements by means of an oscillating stamp is measured along the Y-axis and the deflection of the deformation elements is measured along the X-axis. The gradient of an obtained curve indicates the stiffness of the deformation element in question, whereas the area between the increasing branch (loading) and the decreasing branch (unloading) of the curve reflects the energy loss during deformation, i.e., energy which is not elastically regained but irreversibly transformed into heat by means of, for example, relaxation processes. At 23° C. (i.e., room temperature) and at 60° C., consistency exists, to a great extent, in the behavior of the second deformation elements according to the invention and the prior art foamed element. Moreover, long term studies do not show a substantial difference in their deformation properties.

Figure 6C:
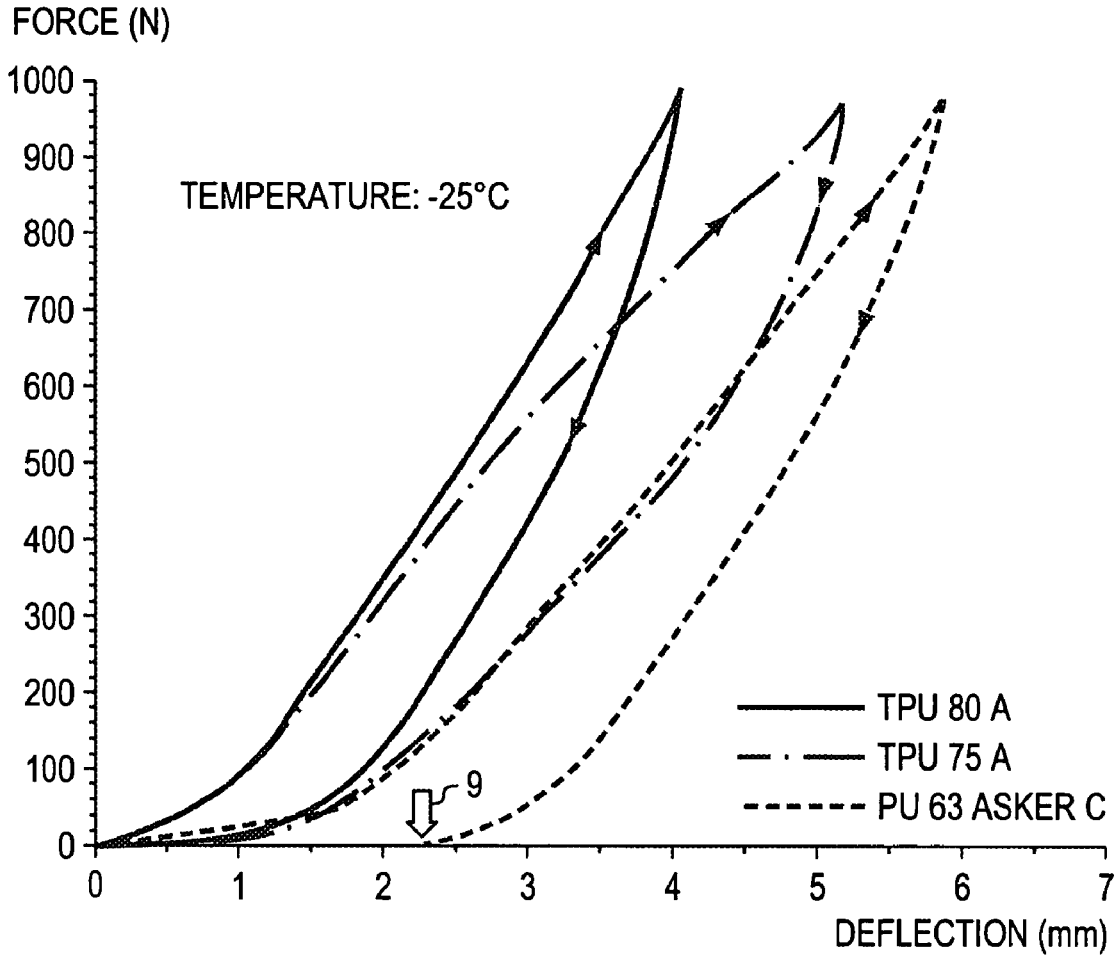
FIG. 6C is a graph depicting comparative measurements of the deformation properties at −25° C. of second deformation elements in accordance with the invention and of a prior art deformation element made out of a foamed material.

Referring now to FIG. 6C, it can be seen, however, that the behavior of the second deformation elements in accordance with the invention and the prior art foamed element is different at the low temperature of −25° C. Whereas the second deformation elements according to the invention still show a substantially elastic behavior and, in particular, return to their starting configuration after the external force is removed, the foamed deformation element of the prior art remains permanently deformed at a deflection of approximately 2.3 mm, as indicated by arrow 9 in FIG. 6C. As such, while the deformation properties of the second deformation elements in accordance with the present invention are almost independent from the ambient temperature, the deformation properties of the foamed deformation element of the prior art is not. As a result, the foamed deformation element of the prior art is not suitable for use in a shoe sole.

In contrast to the known deformation elements of the prior art, the second deformation elements in accordance with the invention can be modified in many aspects to obtain specific properties. For example, changing the geometry of the second deformation elements 1 (e.g., larger or smaller distances between the side walls 2A, 2B, the upper side 4 and the lower side 5, and/or the upper side 4' and the lower side 5'; changes to the thickness of the side walls 2A, 2B and/or the tension element 3; additional upper sides 4, 4' and/or lower sides 5, 5'; changes to the angle of the side walls 2A, 2B; and convex or concave borders for reinforcing or reducing stiffness) or using different materials for the second deformation elements enables adaptation of the second deformation elements to their respective use. For example, the second deformation elements in accordance with the invention can be modified to take into account the particular positions of the second deformation elements within the shoe sole 50, their tasks, and/or the requirements for the shoe in general, such as, for example, its expected field of use and the size and weight of the wearer.

The various components of the second deformation elements can be manufactured by, for example, injection molding or extrusion. Extrusion processes may be used to provide a uniform shape, such as a single monolithic frame. Insert molding can then be used to provide the desired geometry of, for example, the recess 11 and the hollow volumes 7, or the hollow volumes 7 could be created in the desired locations by a subsequent machining operation. Other manufacturing techniques include melting or bonding additional portions. For example, the connecting surfaces 10 may be adhered to the upper side 4 and/or the lower side 5 of the second deformation elements 1A, 1B with a liquid epoxy or a hot melt adhesive, such as ethylene vinyl acetate (EVA). In addition to adhesive bonding, portions can be solvent bonded, which entails using a solvent to facilitate fusing of the portions to be added to the sole 50. The various components can be separately formed and subsequently attached or the components can be integrally formed by a single step called dual injection, where two or more materials of differing densities are injected simultaneously.

The various components can be manufactured from any suitable polymeric material or combination of polymeric materials, either with or without reinforcement. Suitable materials include: polyurethanes, such as a thermoplastic polyurethane (TPU); EVA; thermoplastic polyether block amides, such as the Pebax® brand sold by Elf Atochem; thermoplastic polyester elastomers, such as the Hytrel® brand sold by DuPont; thermoplastic elastomers, such as the Santoprene® brand sold by Advanced Elastomer Systems, L.P.; thermoplastic olefin; nylons, such as nylon 12, which may include 10 to 30 percent or more glass fiber reinforcement; silicones; polyethylenes; acetal; and equivalent materials. Reinforcement, if used, may be by inclusion of glass or carbon graphite fibers or para-aramid fibers, such as the Kevlar® brand sold by DuPont, or other similar method. Also, the polymeric materials may be used in combination with other materials, for example natural or synthetic rubber. Other suitable materials will be apparent to those skilled in the art.

Figure 7:
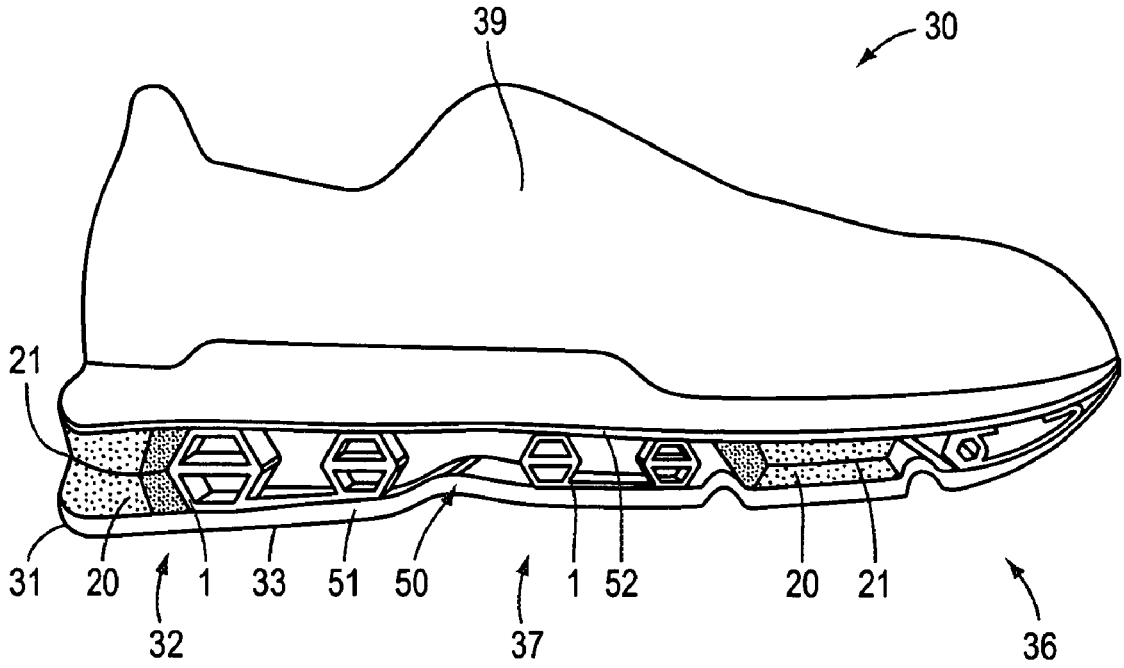
FIG. 7 is a schematic side view of an article of footwear including a shoe sole in accordance with one embodiment of the invention.

FIG. 7 depicts one embodiment of an article of footwear 30 that includes an upper 39 and a sole 50 in accordance with the invention. FIG. 8 depicts an exploded view of one embodiment of the shoe sole 50 for the article of footwear 30 of FIG. 7. Using the second deformation elements 1 in certain sole regions and not others can create pressure points on the foot and be uncomfortable for athletes. Accordingly, as shown in FIGS. 7 and 8, a plurality of first deformation elements 20 made out of foamed materials may be arranged in particularly sensitive sole areas and a plurality of second deformation elements 1 may be arranged in other areas. The second deformation elements 1 and the first deformation elements 20 are, in one embodiment, arranged between an outsole 51 and the load distribution plate 52.

In one embodiment, one or more first deformation elements 20 made out of a foamed material are arranged in an aft portion 31 of a heel region 32 of the sole 50. Placement of the first deformation elements 20 in the aft portion 31 of the heel region 32 of the sole 50 optimally cushions the peak loads that arise on the foot during the first ground contact, which is a precondition for a particularly high comfort for a wearer of the article of footwear 30. As shown, in one embodiment, the first deformation elements 20 further include horizontally extending indentations/grooves 21 to facilitate deformation in a predetermined manner.

Figure 8:
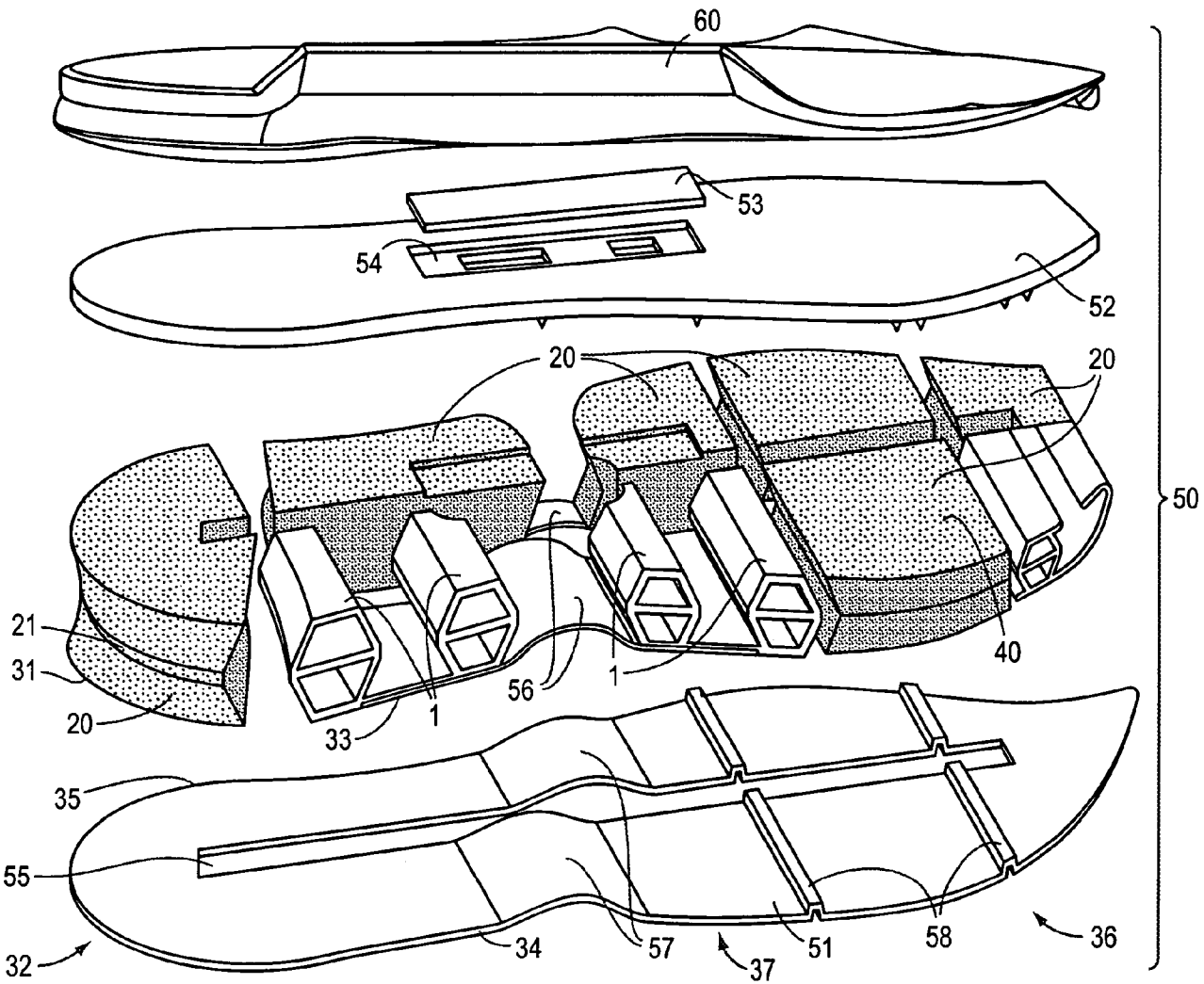
FIG. 8 is an exploded schematic perspective view of the construction of the shoe sole of FIG. 7.

Referring still to FIGS. 7 and 8, second deformation elements 1 are, in one embodiment, provided in a front portion 33 of the heel region 32 to assist the one or more first deformation elements 20 in the aft portion 31 and to assure, in case of their failure (e.g., due to low temperatures), a minimum amount of elasticity for the shoe sole 50. Moreover, placement of the second deformation elements 1 in the front portion 33 of the heel region 32 of the sole 50 simultaneously avoids premature wear of the first deformation elements 20 in the heel region 32.

The distribution of the second deformation elements 1 and the first deformation elements 20 on the medial side 34 and the lateral side 35 of the sole 50, as well as their individual specific deformation properties, can be tuned to the desired requirements, such as, for example, avoiding supination or excessive pronation. In one particular embodiment, this is achieved by making the above mentioned geometrical changes to the second deformation elements 1 and/or by selecting appropriate material(s) for the second deformation elements 1.

Figure 9:
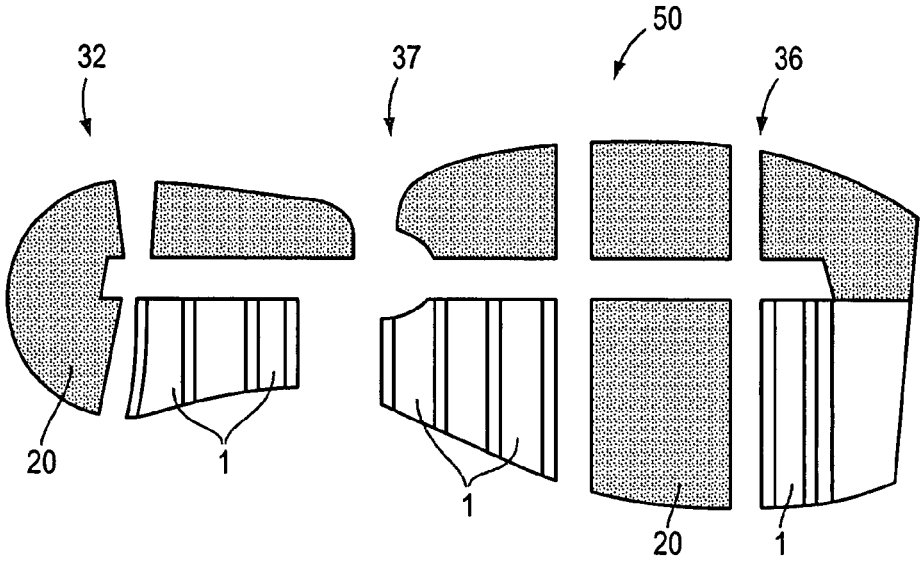
FIG. 9 is an arrangement of first deformation elements and second deformation elements in the shoe sole of FIGS. 7 and 8 in accordance with one embodiment of the invention.

FIG. 9 depicts one distribution of the deformation elements 1, 20 in accordance with an embodiment of the invention. In the forefoot region 36, foamed deformation elements 20 are arranged in areas of the sole 50 that correspond to the metatarsal heads of the wearer's foot. This region of the sole 50 is subjected to a particular load during push-off at the end of the step cycle. Accordingly, in order to avoid localized pressure points on the foot, the second deformation elements 1 are not arranged in this sole region. In one embodiment, to assist the first deformation element 20 below the metatarsal heads of the wearer's foot and to assure a correct position of the foot during the pushing-off phase, second deformation elements 1 are provided fore and aft the metatarsal heads of the wearer's foot. The second deformation elements 1 protect the first deformation element 20 against excessive loads. Simultaneously, the second deformation elements 1 allow for a more purposeful control of the series of movements of the wearer's foot during push off, thereby maintaining the neutral position of the wearer's foot and avoiding supination or pronation.

Referring again to FIG. 8, in one embodiment, providing the load distribution plate 52 above the deformation elements 1, 20 evenly distributes the forces acting on the foot over the full area of the sole 50 and thereby avoids localized peak loads on the foot. As a result, comfort for the wearer of the article of footwear 30 is increased. In one embodiment, the mid-foot region 37 can be reinforced by a light, but highly stable carbon fiber plate 53, inserted into a corresponding recess 54 of the load distribution plate 52.

In one embodiment, a gap 55 is provided in the outsole 51 and curved interconnecting ridges 56 are provided between the heel region 32 and the forefoot region 36 of the midsole 40. The curved interconnecting ridges 56 reinforce corresponding curvatures 57 in the outsole 51. The torsional and bending behavior of the sole 50 is influenced by the form and length of the gap 55 in the outsole 51, as well as by the stiffness of the curved interconnecting ridges 56 of the midsole 40. In another embodiment, a specific torsion element is integrated into the sole 50 to interconnect the heel region 32 and the forefoot region 36 of the sole 50.

In one embodiment, ridges 58 are arranged in the forefoot region 36 of the outsole 51. In another embodiment, ridges 58 are additionally or alternatively arranged in the heel region 32 of the outsole 51. The ridges 58 provide for a secure anchoring of the deformation elements 1, 20 in the sole 50. In one embodiment, as illustrated in FIG. 8, the sole 50 includes an additional midsole 60.

Figure 10:
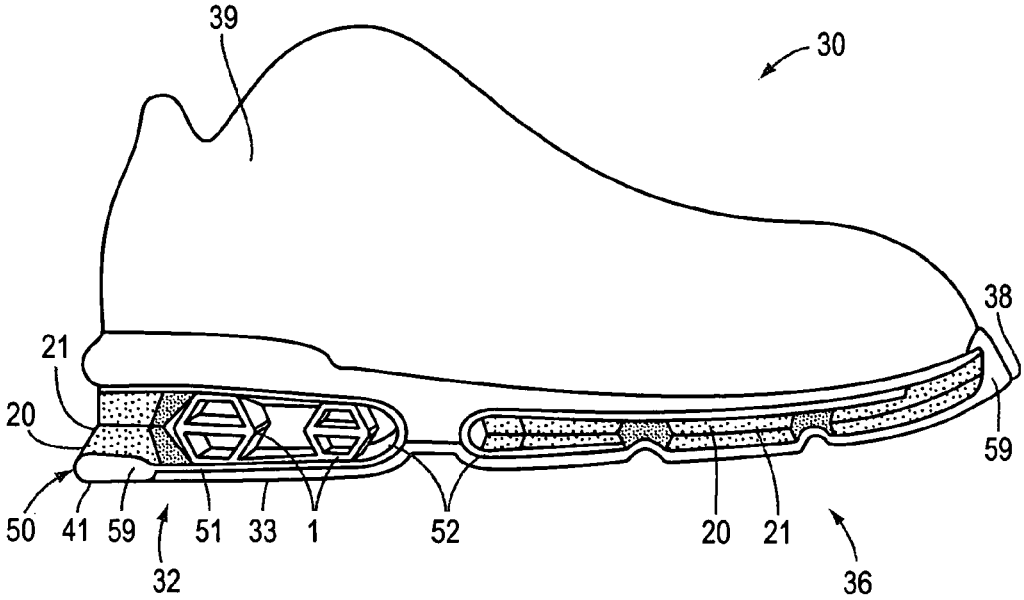
FIG. 10 is a schematic side view of an article of footwear including an alternative embodiment of a shoe sole in accordance with the invention.

FIG. 10 depicts an alternative embodiment of an article of footwear 30 in accordance with the invention. In the illustrative embodiment shown, the second deformation elements 1 are exclusively arranged in the front portion 33 of the heel region 32 of the sole 50. In this embodiment, the forefoot region 36 and the heel region 32 have separate load distribution plates 52. Both load distribution plates 52 are bent in a recumbent U-shaped configuration, when viewed from the side, and encompass at least partially one or more deformation elements 1, 20. This structure further increases the stability of the sole 50. In one embodiment, wear resistant reinforcements 59 are arranged at a front end 38 and/or at the rear end 41 of the outsole 51.

Providing a U-shaped load distribution plate 52 is independent of the use of the second deformation elements 1. In another embodiment, second deformation elements 1 are only provided in the forefoot region 36, but, nevertheless, two load distribution plates 52, as shown in FIG. 10, are provided. In yet another embodiment, second deformation elements 1 are provided in both the heel region 32 and in the forefoot region 36. Additional examples and details of load distribution plates are found in U.S. patent application Ser. Nos. 10/099,859 and 10/391,488, now U.S. Pat. Nos. 6,722,058 and 6,920,705, respectively, the disclosures of which are hereby incorporated herein by reference in their entireties.

Figure 11:
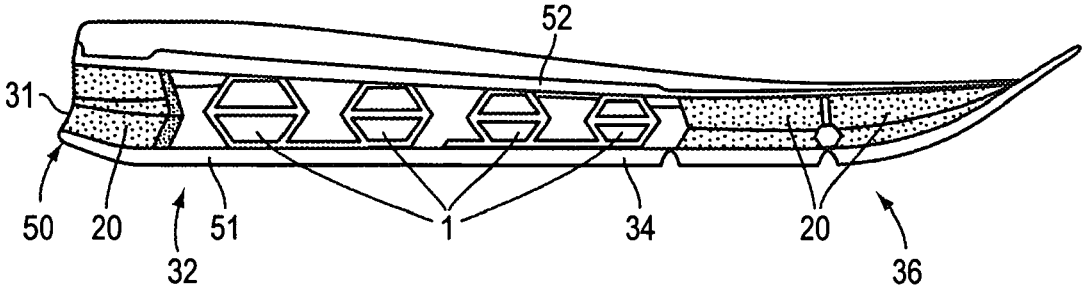
FIG. 11 is a schematic side view of an alternative shoe sole in accordance with the invention.
Figure 12:
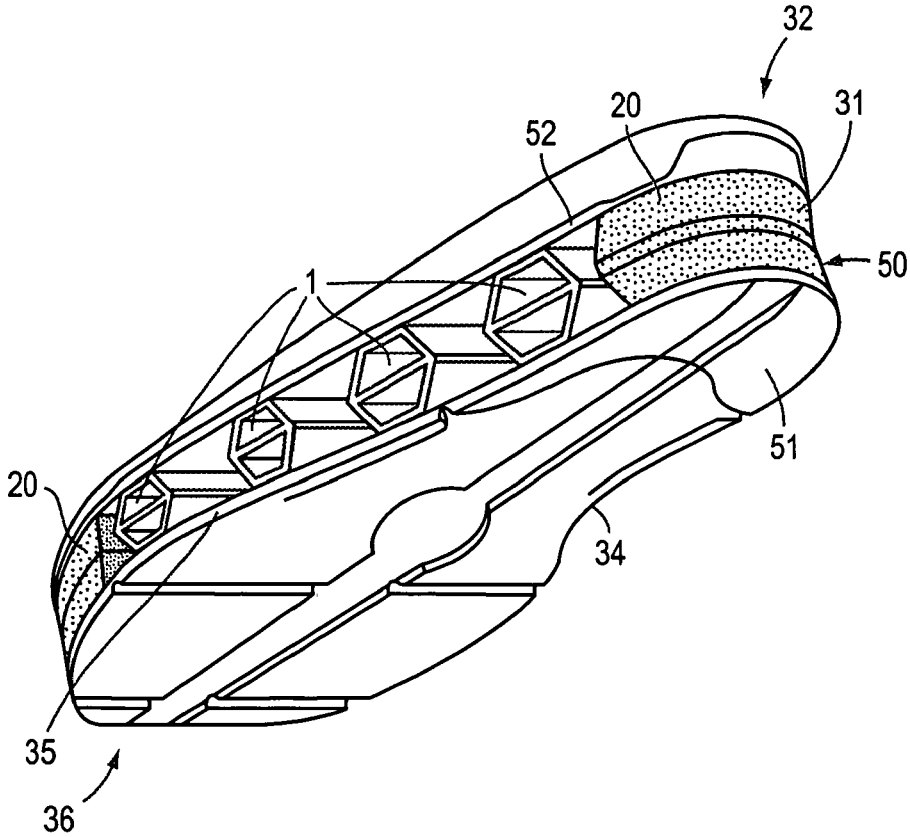
FIG. 12 is a schematic perspective bottom lateral view of the shoe sole of FIG. 11.

In another embodiment, as illustrated in FIGS. 11 and 12, second deformation elements 1 are provided on the lateral side 35, as well as on the medial side 34, of the sole 50, contrary to the embodiment depicted in FIG. 9. In yet another embodiment, the second deformation elements 1 are provided only on the lateral side 35 of the sole 50. Additionally, a configuration of second deformation elements 1 extending from the lateral side 35 to the medial side 34 may be provided.

Referring still to FIGS. 11 and 12, the load distribution plate 52 extends along almost the entire length of the shoe sole 50, i.e., from the heel region 32 to the forefoot region 36. The first deformation elements 20 are provided in the particularly sensitive areas of the shoe sole 50, i.e., in the aft portion 31 of the heel region 32 and approximately below the metatarsal heads of a wearer's foot. The other sole areas are supported by second deformation elements 1.

Figure 13:
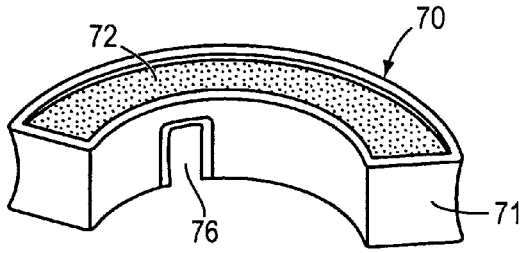
FIG. 13 is a schematic perspective front view of a first deformation element in accordance with one embodiment of the invention.
Figure 14:
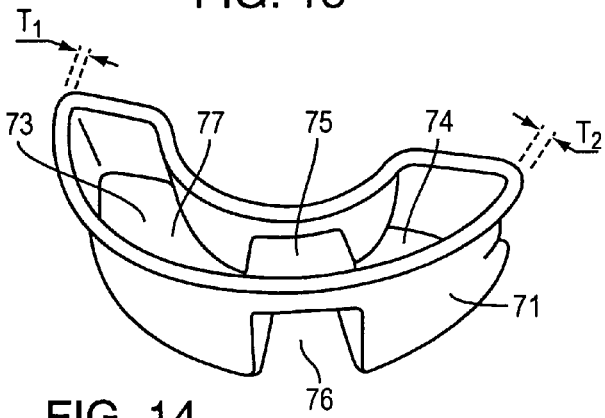
FIG. 14 is a schematic perspective rear view of a shell of the first deformation element of FIG. 13 without any foamed material.

FIGS. 13–14 depict a particular embodiment of a first deformation element 70 in accordance with the invention. The first deformation element 70 includes a foamed material 72. In contrast to the first deformation element 20 described above, which consists exclusively of foamed material, the first deformation element 70 is a hybrid structure that includes an outer shell 71 forming one or more cavities 77 that are filled with the foamed material 72. Thus, the superior cushioning properties of the foamed material 72 are combined with a potentially wide range of adjustment options that may be provided by varying the shape, the material, and the wall thickness of the outer shell 71. The first deformation element 70 is illustrated as it is used in the rearmost portion of the heel region 32. The first deformation element 70, including the outer shell 71 and the foamed material 72, may, however, also be used in other parts of the shoe sole 50, in a similar manner to the above described first deformation elements 20.

The outer shell 71 serves several purposes. First, the outer shell 71 provides cushioning in a manner similar to the second deformation elements 1, due to its own elastic deflection under load. In addition, the outer shell 71 contains the foamed material 72 arranged therein and prevents the excessive expansion of the foamed material 72 to the side in the case of peak loads. As a result, premature fatigue and failure of the foamed material 72 is avoided. Moreover, in a manner similar to the second deformation elements 1, the cushioning properties of the outer shell 71 are less temperature dependent than are the cushioning properties of the foamed material 72 alone. Further, the outer shell 71, which encapsulates the one or more foamed materials 72, achieves the desired cushioning properties with a first deformation element 70 of reduced size. Accordingly, the limited space available on the sole 50, in particular in the rearfoot portion, can be more effectively used for arranging further functional elements thereon.

As shown in the presentation of the outer shell 71 in FIG. 14, the first deformation element 70, in one embodiment, includes a lateral chamber 73 and a medial chamber 74. As a result, the cushioning properties for the lateral side 35, where the first ground contact will typically occur for the majority of athletes, and for the medial side 34 can be separately designed. For example, in one embodiment, the lateral chamber 73 is larger than the medial chamber 74 and is designed to cushion the high ground reaction forces arising during the first ground contact with the heel region 32. Alternatively, in other embodiments, the medial chamber 74 is larger than the lateral chamber 73.

The lateral chamber 73 and the medial chamber 74 are, in one embodiment, interconnected by a bridging passage 75. The bridging passage 75 may also be filled with the foamed material 72. Due to the improved cushioning properties of the first deformation element 70, it is not necessary to cover the entire rearfoot portion with the first deformation element 70 and an open recess 76 may be arranged below the bridging passage 75. The recess 76 may be used to receive further functional elements of the shoe sole 50. Additionally, the recess 76 allows for a more independent deflection of the lateral chamber 73 and the medial chamber 74 of the first deformation element 70.

Both the outer shell 71 and the foam material 72 determine the elastic properties of the first deformation element 70. Accordingly, the first deformation element 70 provides several possibilities for modifying its elastic properties. Gradually changing the wall thickness of the outer shell 71 from the medial ($T_2$) to the lateral ($T_1$) side, for example, will lead to a gradual change in the hardness values of the first deformation element 70. This may be achieved without having to provide a foamed material 72 with a varying density. As another example, reinforcing structures inside the lateral chamber 73 and/or the medial chamber 74, which may be similar to the tension element 3 of the second deformation element 1, allow for selective strengthening of specific sections of the first deformation element 70. As a further means for modifying the elastic properties of the first deformation element 70, foamed materials 72 of different densities may be used in the lateral chamber 73 and the medial chamber 74 of the first deformation element 70, or, in alternative embodiments, in further cavities of the first deformation element 70.

Figure 15A:
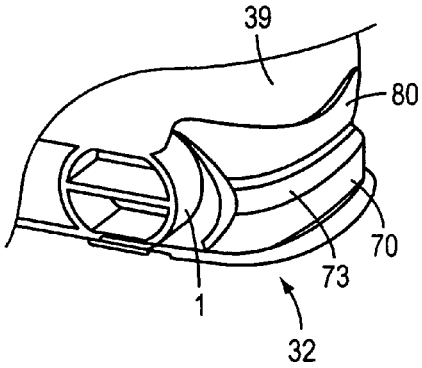
FIG. 15A is a schematic lateral side view of the rearmost portion of a shoe sole including the first deformation element of FIGS. 13 and 14.
Figure 15B:
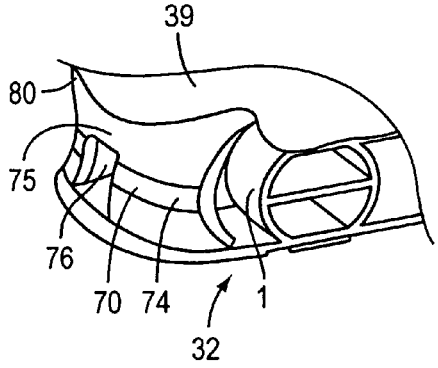
FIG. 15B is a schematic medial side view of the rearmost portion of a shoe sole including the first deformation element of FIGS. 13 and 14.

FIGS. 15A–15B depict one embodiment of an arrangement of the first deformation element 70 in the rearmost portion of the heel region 32 of the shoe sole 50 in accordance with the invention. As in the embodiments that use the first deformation element 20, discussed above, a second deformation element 1 is arranged next to the first deformation element 70 and provides additional support immediately after the cushioning of the heel strike. In one embodiment, as depicted in FIGS. 15A and 15B, an upwardly directed projection 80 of the first deformation element 70 is arranged on top of the bridging passage 75. The projection 80 facilitates a reliable bonding of the first deformation element 70 to the rest of the shoe sole 50 and to the upper 39 of the article of footwear 30.

In one embodiment, the outer shell 71 is made from a thermoplastic material, such as, for example, a thermoplastic urethane (TPU). TPU can be easily three-dimensionally formed at low costs by, for example, injection molding. Moreover, an outer shell 71 made from TPU is not only more durable than a standard foam element, but, in addition, its elastic properties are less temperature dependent than a standard foam element and thereby lead to more consistent cushioning properties for the article of footwear 30 under changing conditions. The thermoplastic material may have an Asker C hardness of about 65.

The foamed material 72 is, in one embodiment, a polyurethane (PU) foam. The foamed material 72 may be prefabricated and subsequently inserted into the outer shell 71, or, alternatively, cured inside the cavity 77 of the outer shell 71. In one embodiment, the foamed material 72 is a PU foam having a Shore A hardness of about 58 and exhibits about 45% rebound.

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive.

What is claimed is:

1. A sole for an article of footwear, the sole comprising:

a first area including a first deformation element comprising a shell defining a cavity at least partially filled with a foamed material; and a second area including a second deformation element comprising an open-walled structure free from foamed materials, wherein the second deformation element further comprises at least two side walls and at least one tension element interconnecting center regions of the side walls.

2. The sole of claim 1, wherein the side walls and the tension element comprise a single piece.

3. The sole of claim 2, wherein the single piece comprises a thermoplastic material.

4. The sole of claim 3, wherein the thermoplastic material comprises a thermoplastic polyurethane.

5. The sole of claim 3, wherein the thermoplastic material has a hardness between about 70 Shore A and about 85 Shore A.

6. The sole of claim 3, wherein the thermoplastic material has a hardness between about 75 Shore A and about 80 Shore A.

7. The sole of claim 1, wherein at least one of the tension element and the side walls comprises a thickness from about 1.5 mm to about 5 mm.

8. The sole of claim 1, wherein a thickness of at least one of the tension element and the side walls increases along a length of the second deformation element.

9. The sole of claim 1, wherein the side walls are further interconnected by at least one of an upper side and a lower side.

10. The sole of claim 1 further comprising two second deformation elements arranged adjacent each other.

11. The sole of claim 10, wherein at least one of an upper side and a lower side interconnects adjacent side walls of the two second deformation elements.

12. The sole of claim 11, wherein the two second deformation elements are further interconnected by at least one of an upper connecting surface and a lower connecting surface.

13. The sole of claim 12, wherein the connecting surface comprises a three-dimensional shape for adaptation to additional sole components.

14. The sole of claim 1, wherein at least one of the side walls has a non-linear configuration.

15. The sole of claim 1, wherein the first area is arranged in an aft portion of a heel region of the sole.

16. The sole of claim 1, wherein the second area is arranged in a front portion of a heel region of the sole.

17. The sole of claim 1, wherein the first area is arranged to correspond to metatarsal heads of a wearer's foot.

18. The sole of claim 17, wherein the second area is arranged fore of the metatarsal heads of the wearer's foot.

19. The sole of claim 17, wherein the second area is arranged aft of the metatarsal heads of the wearer's foot.

20. The sole of claim 1, wherein the first deformation element comprises at least one horizontally extending indentation.

21. The sole of claim 1, wherein the first deformation element and the second deformation element are arranged below at least a portion of at least one load distribution plate of the sole.

22. The sole of claim 21, wherein the load distribution plate at least partially three-dimensionally encompasses at least one of the first deformation element and the second deformation element.

23. The sole of claim 1, wherein the shell comprises a ther-moplastic material and the foamed material comprises a polyurethane foam.

24. The sole of claim 23, wherein the thermoplastic material comprises a thermoplastic urethane.

25. The sole of claim 1, wherein the shell comprises a varying wall thickness.

26. The sole of claim 1, wherein the first deformation element is arranged at least partially in a rearmost portion of the sole and the cavity comprises a lateral chamber and a medial chamber.

27. The sole of claim 26, wherein the lateral chamber is larger than the medial chamber.

28. The sole of claim 26, wherein the lateral chamber and the medial chamber are interconnected by a bridging passage.

29. The sole of claim 28, wherein the bridging passage is filled with the foamed material.

30. The sole of claim 26, wherein the shell defines a recess open to an outside, the recess arranged between the lateral chamber and the medial chamber.

31. An article of footwear comprising an upper and a sole, the sole comprising:

a first area including a first deformation element comprising a shell defining a cavity at least partially filled with a foamed material; and a second area including a second deformation element comprising an open-walled structure free from foamed materials, wherein the second deformation element further comprises at least two side walls and at least one tension element interconnecting center regions of the side walls.

32. A sole for an article of footwear, the sole comprising:

a first area including a first deformation element comprising a foamed material; and a second area including a second deformation element comprising an open-walled structure free from foamed materials, wherein the first deformation element comprises a shell defining a cavity at least partially filled with the foamed material and arranged at least partially in a rearmost portion of the sole, wherein the cavity comprises a lateral chamber and a medial chamber.

* * * * *